US011505300B1

(12) United States Patent
Yamaguchi et al.

(10) Patent No.: US 11,505,300 B1
(45) Date of Patent: Nov. 22, 2022

(54) SHIP MANEUVERING SYSTEM AND SHIP MANEUVERING METHOD

(71) Applicant: YAMAHA HATSUDOKI KABUSHIKI KAISHA, Iwata (JP)

(72) Inventors: Kohei Yamaguchi, Shizuoka (JP); Yoshikazu Nakayasu, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 366 days.

(21) Appl. No.: 16/827,844

(22) Filed: Mar. 24, 2020

Related U.S. Application Data

(60) Provisional application No. 62/823,111, filed on Mar. 25, 2019.

(51) Int. Cl.

| | |
|---|---|
| ***B63H 25/42*** | (2006.01) |
| ***B63H 25/02*** | (2006.01) |
| ***B63H 20/12*** | (2006.01) |
| ***B63H 20/00*** | (2006.01) |

(52) U.S. Cl.
CPC ..... *B63H 25/42* (2013.01); *B63H 20/12* (2013.01); *B63H 25/02* (2013.01); *B63H 2020/003* (2013.01); *B63H 2025/022* (2013.01); *B63H 2025/026* (2013.01)

(58) Field of Classification Search
CPC .. B63H 20/12; B63H 2020/003; B63H 25/02; B63H 2025/022; B63H 2025/024; B63H 2025/026; B63H 25/42
See application file for complete search history.

(56) References Cited

U.S. PATENT DOCUMENTS

| | | | | |
|---|---|---|---|---|
| 8,589,004 | B1 * | 11/2013 | Kanno | B63H 25/42 440/4 |
| 9,266,594 | B2 * | 2/2016 | Lindeborg | B63H 20/00 |
| 10,137,973 | B2 * | 11/2018 | Lindeborg | B63J 99/00 |
| 11,072,409 | B2 * | 7/2021 | Nilsson | B63B 34/05 |
| 2006/0019552 | A1 | 1/2006 | Okuyama | |

FOREIGN PATENT DOCUMENTS

| | | |
|---|---|---|
| JP | 2006-035884 A | 2/2006 |

* cited by examiner

*Primary Examiner* — Ajay Vasudeva
(74) *Attorney, Agent, or Firm* — Keating and Bennett, LLP

(57) ABSTRACT

A controller generates a first forward thrust with a first propulsion device and generates a first backward thrust with a second propulsion device with a same number as the first propulsion device in case that the backward thrust is less than a predetermined threshold. The controller generates a second forward thrust larger than the first forward thrust with the first propulsion device and generates a second backward thrust with each of the second propulsion devices greater than the first propulsion device in case that the backward thrust is greater than or equal to the predetermined threshold.

10 Claims, 8 Drawing Sheets

SHIP MANEUVERING SYSTEM AND SHIP MANEUVERING METHOD

CROSS REFERENCE TO RELATED APPLICATIONS

This application claims the benefit of priority to U.S. Provisional Patent Application No. 62/823,111 filed on Mar. 25, 2019. The entire contents of this application are hereby incorporated herein by reference.

BACKGROUND OF THE INVENTION

1. Field of the Invention

The present invention relates to a ship maneuvering system and a ship maneuvering method.

2. Description of the Related Art

In the conventional technology, a ship maneuvering system in which a ship pivotally turns using a plurality of propulsion devices is known. For example, Japanese Patent Application Laid-Open No. 2006-35884 discloses a technique in which a ship is turned forward on a turning circle using four propulsion devices (see FIGS. 6A and 6B). This type of ship can generally be pivotally turned as well as turned on the turning circle.

In the conventional ship, for example, when the ship tries to pivotally turn clockwise, as shown in FIG. 8A of the present application, the left propulsion device a1 generates a forward thrust and the right propulsion device b1 generates a backward thrust in a case that the pivotal turning state of the ship is in a low output state. As shown in FIG. 8B, the left propulsion device a1 and the left middle propulsion device a2 generate the forward thrust and the right propulsion device b1 and the right middle propulsion device b2 generate the backward thrust in a case that the pivotal turning state of the ship is in a high output state.

In a case that the pivotal turning state of the ship is in the low output state, the number of the propulsion device a1 for the forward thrust and the number of the propulsion device b1 for backward thrust are one. In a case that the pivotal turning state of the ship is in the high output state, the number of propulsion devices a1, a2 for the forward thrust and the number of propulsion devices b1 and b2 for backward propulsion are two. When the number of these propulsion devices increases, the forward thrust and the backward thrust of each of the propulsion device a1, a2, b1, b2 decreases. The ship turns counterclockwise by reversing the direction of the above thrust.

When the pivotal turning state of the ship is in the low output state (in the case of FIG. 8A), as the forward thrust of the propulsion device a1 increases, the backward thrust of the propulsion device b1 also increases. In this state, when the forward thrust F of the propulsion device a1 reaches a predetermined threshold, the pivotal turning state of the ship is switched from the low output state to the high output state. Thus, the pivotal turning state of the ship is switched based on the forward thrust F of the propulsion device a1.

In the above-described ship, the shape of the propeller and drainage structure are designed such that the forward thrust is generated more efficiently than the backward thrust. Therefore, when the propeller pushes water backward, the propeller efficiently generates a forward thrust. On the other hand, when the propeller pushes the water forward, the backward thrust is smaller than the forward thrust because the exhaust discharged backward may be caught in the propeller.

Thus, in a case that the performance of the plurality of propulsion devices a1 and b1 is the same and the rotation speed of the propulsion device a1 for the forward thrust is the same as the rotation speed of the propulsion device b1 for the backward thrust, the backward thrust is becomes smaller than the forward thrust. For this reason, when the ship is pivotally turned, the rotation speed of the propulsion device b1 for the backward thrust is larger than the rotation speed of the propulsion device a1 for the forward thrust such that the forward and backward thrusts acting on the ship are balanced.

For this reason, as the above-described threshold of the forward thrust increases, the rotational speed of the backward thrust increases. If the pivotal turning state of the ship is switched in this state, when the propulsion devices b1 and b2 for the backward thrust are switched from one device to two devices, the rotation speed of each of the propulsion devices b1, b2 is significantly reduced. Thus, a shock accompanying the change of the rotation speed occurs on the ship. Further, shift noise is generated in the ship by changing the number of propulsion devices for the backward thrust. These phenomena may occur not only when pivotally turning the ship but also when turning the ship on the turning circle.

SUMMARY OF THE INVENTION

In view of the above-described problems, preferred embodiments of the present invention provide ship maneuvering systems and methods, each of which is capable of suitably reducing shock and noise when the number of propulsion devices changes.

A ship maneuvering system according to a preferred embodiment of the present invention includes a plurality of first propulsion devices, a plurality of second propulsion devices, and an operator to output an operation signal to rotate the ship.

A controller is configured or programmed to generate a first forward thrust with the first propulsion devices and generate a first backward thrust with the second propulsion devices with a same number of propulsion devices as the number of first propulsion devices when the backward thrust is less than a predetermined threshold.

The controller is further configured or programmed to generate a second forward thrust larger than the first forward thrust with the first propulsion devices and generate a second backward thrust with each of the second propulsion devices greater than the number of first propulsion device when the backward thrust is greater than or equal to the predetermined threshold.

A ship maneuvering method according to another preferred embodiment of the present invention is executed by a controller to maneuver a ship including a plurality of first propulsion devices and a plurality of second propulsion devices.

The method includes acquiring an operation signal to rotate the ship, and generating a forward thrust with the first propulsion devices and generating a backward thrust with the second propulsion devices based on the operation signal.

The method further includes generating a first forward thrust with the first propulsion devices and generating a first backward thrust with the second propulsion devices with the same number of propulsion devices as the number of first propulsion devices when the backward thrust is less than a predetermined threshold The method further includes generating a second forward thrust larger than the first forward thrust with the first propulsion devices and generating a second backward thrust with each of the second propulsion devices greater than the number of first propulsion devices when the backward thrust is greater than or equal to the predetermined threshold.

According to preferred embodiments of the present invention, it is possible to suitably reduce shock and noise when the number of propulsion devices changes in the ship maneuvering system and the ship maneuvering method.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
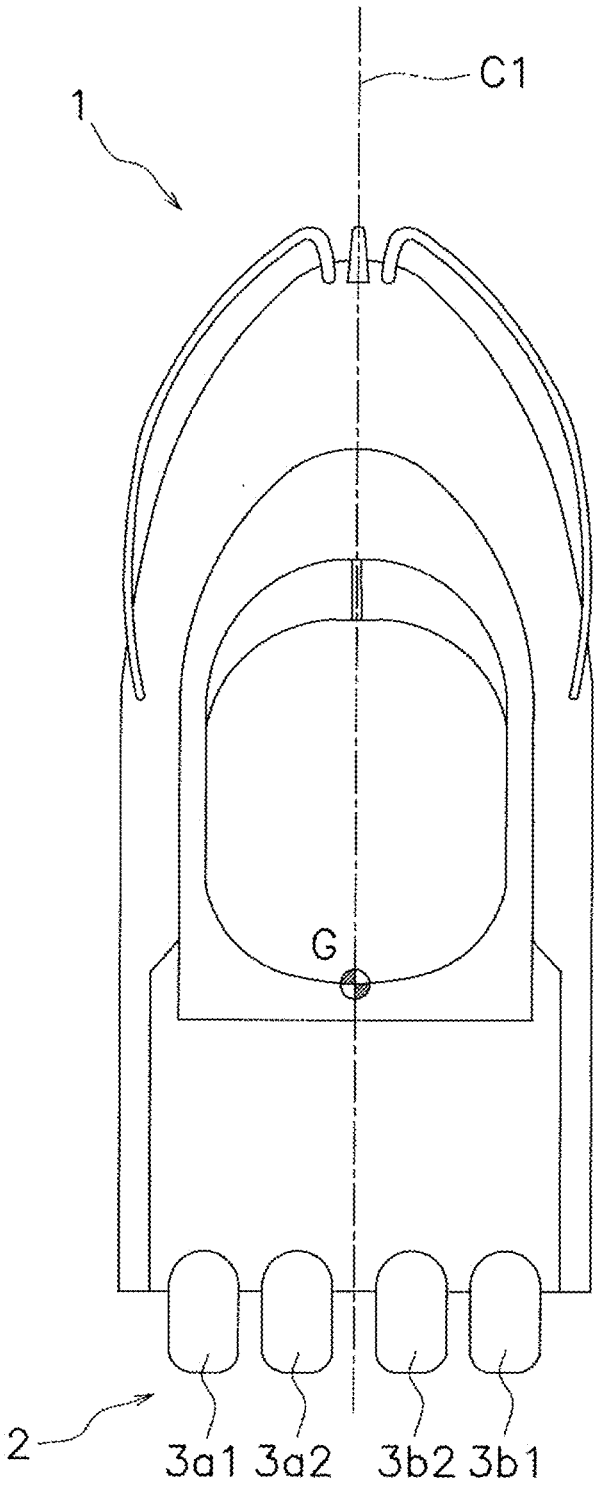
FIG. 1 is a top view of a ship according to a preferred embodiment of the present invention.

Hereinafter, preferred embodiments will be described with reference to the drawings. FIG. 1 is a top view of a ship 1 according to a preferred embodiment of the present invention. The ship 1 is equipped with the ship maneuvering system 2 according to a preferred embodiment of the present invention. As shown in FIG. 1, the ship maneuvering system 2 includes a plurality of propulsion devices 3*a*1, 3*a*2, 3*b*1, and 3*b*2. The plurality of propulsion devices 3*a*1, 3*a*2, 3*b*1, 3*b*2 are outboard motors, for example.

In the following description, the front, rear, left, right, up, and down directions mean the front, rear, left, right, up, and down directions of the ship 1, respectively. For example, a center line C1 extending in the front-rear direction of the ship 1 passes through the center of gravity G of the ship 1. The front-back direction extends along the center line C1. The forward direction extends upward along the center line C1 in FIG. 1. The rear direction extends downward along the center line C1 in FIG. 1.

The left-right direction (width direction) is perpendicular to the center line C1 in FIG. 1. The left direction is perpendicular to the center line C1 and on a left side of the center line C1 in FIG. 1. The right direction is perpendicular to the center line C1 and on a right side of the center line C1 in FIG. 1. The vertical direction is perpendicular to the front-rear direction and the left-right direction.

As shown in FIG. 1, the plurality of propulsion devices 3*a*1, 3*a*2, 3*b*1, 3*b*2 are attached to the stern of the ship 1. The plurality of propulsion devices 3*a*1, 3*a*2, 3*b*1, 3*b*2 are arranged side by side in the width direction (left-right direction) of the ship 1.

The plurality of propulsion devices 3*a*1, 3*a*2, 3*b*1, 3*b*2 generate a thrust to propel the ship 1. Specifically, each of the plurality of propulsion devices 3*a*1, 3*a*2, 3*b*1, 3*b*2 generates a thrust (a forward thrust and a backward thrust) to propel the ship 1 forward and backward.

More specifically, the ship 1 includes a left propulsion device 3*a*1, a left middle propulsion device 3*a*2, a right propulsion device 3*b*1, and a right middle propulsion device 3*b*2. In the plurality of propulsion devices 3*a*1, 3*a*2, 3*b*1, 3*b*2, a propulsion device that generates a forward thrust when the ship 1 rotates is "an example of a first propulsion device". A propulsion device that generates a backward thrust when the ship 1 rotates is an example of a "second propulsion device".

The rotation of the ship 1 includes a pivotal turn of the ship 1 and/or a turn on a turning circle of the ship 1. In the present preferred embodiment, the case in which the turning center of the ship 1 substantially matches the center of gravity G of the ship 1 is referred to as a "pivotal turn". The case in which the turning center of the ship 1 is different from the center of gravity G of the ship 1 is referred to as a "turn on the turning circle".

The left propulsion device 3*a*1 is disposed on the left side of a center line C1 extending in the front-rear direction of the ship 1. The left middle propulsion device 3*a*2 is disposed between the left propulsion device 3*a*1 and the center line C1. The right propulsion device 3*b*1 is disposed on the right side of the center line C1. The right middle propulsion device 3*b*2 is disposed between the right propulsion device 3*b*1 and the center line C1.

The left propulsion device 3*a*1, the left middle propulsion device 3*a*2, the right propulsion device 3*b*1, and the right middle propulsion device 3*b*2 have the same configuration as each other. Therefore, the configuration of an outboard motor will be described using the left propulsion device 3*a*1.

Figure 2:
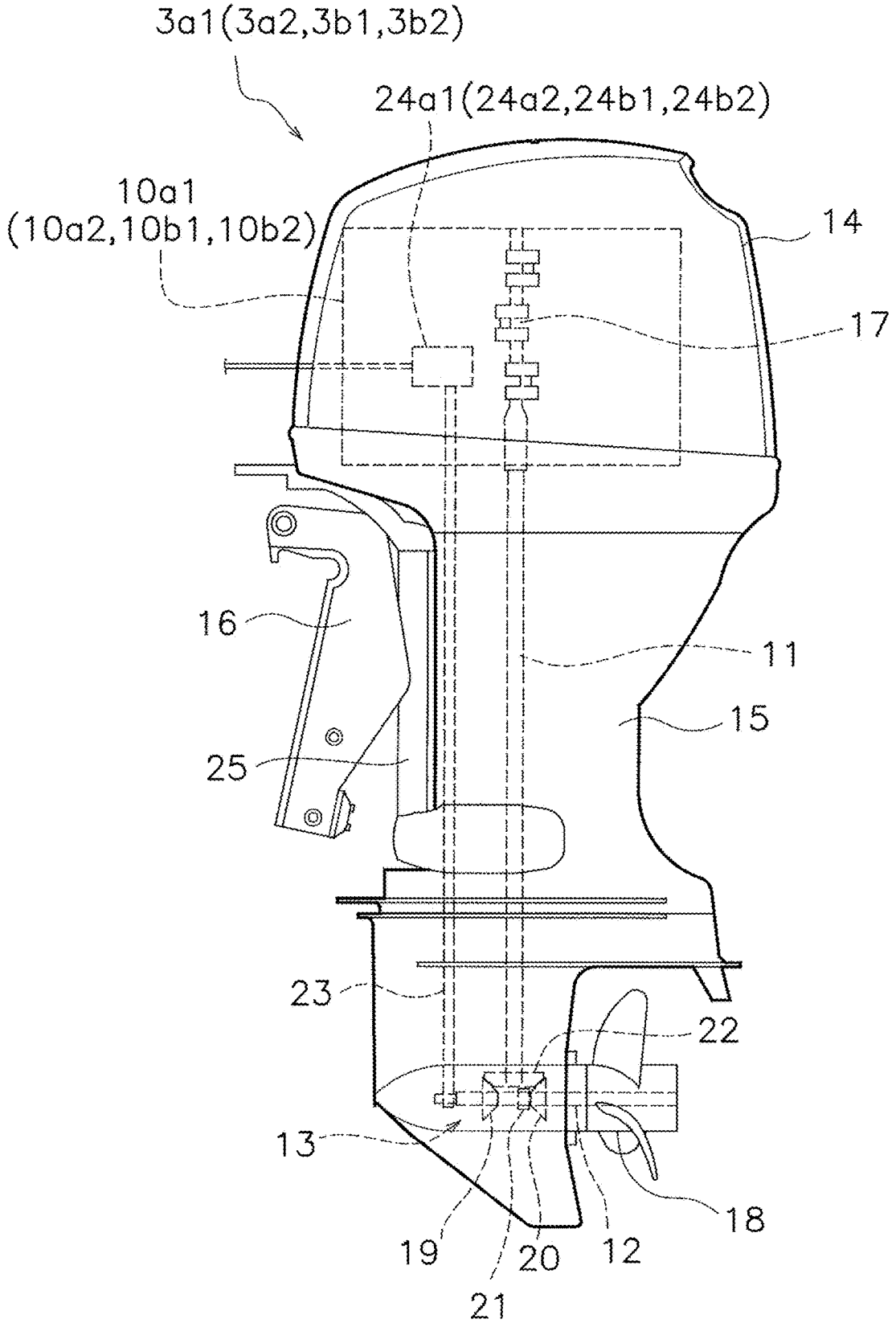
FIG. 2 is a side view of a left propulsion device.

FIG. 2 is a side view of the left propulsion device 3*a*1. The left propulsion device 3*a*1 includes an engine 10*a*1, a drive shaft 11, a propeller shaft 12, a shift mechanism 13, an engine cowl 14, a housing 15, and a bracket 16.

The engine 10*a*1 is a power source that generates the thrust of the ship 1. The engine 10*a*1 is disposed inside the engine cowl 14. The engine 10*a*1 includes a crankshaft 17. The crankshaft 17 extends in the vertical direction.

The drive shaft 11 is connected to crankshaft 17. The drive shaft 11 extends downward from the engine 10*a*1. The propeller shaft 12 extends in a direction intersecting the drive shaft 11. The propeller shaft 12 extends in the front-rear direction. The propeller shaft 12 is connected to the drive shaft 11 via a shift mechanism 13. A propeller 18 is connected to the propeller shaft 12.

The housing 15 is disposed below the engine cowl 14. The drive shaft 11, the propeller shaft 12, and the shift mechanism 13 are disposed in a housing 15. The shift mechanism 13 switches the rotation direction of the power transmitted from the drive shaft 11 to the propeller shaft 12.

The shift mechanism 13 includes a forward gear 19, a reverse gear 20, and a clutch 21. The forward gear 19 and the reverse gear 20 mesh with the bevel gear 22. The bevel gear 22 is attached to the drive shaft 11. The clutch 21 selectively engages the forward gear 19 and the reverse gear 20 with the propeller shaft 12. The clutch 21 is able to move between a forward position, a reverse position, and a neutral position.

The clutch 21 engages the forward gear 19 with the propeller shaft 12 in the forward position. Thus, the rotation of the drive shaft 11 is transmitted to the propeller shaft 12, and the propeller shaft 12 rotates in the forward direction.

The clutch 21 engages the reverse gear 20 with the propeller shaft 12 in the reverse position. Thus, the rotation of the drive shaft 11 is transmitted to the propeller shaft 12, and the propeller shaft 12 rotates in the reverse direction. When the clutch 21 is located at the neutral position, the forward gear 19 and the reverse gear 20 are released from the propeller shaft 12. In this case, the rotation of the drive shaft 11 is not transmitted to the propeller shaft 12.

The left propulsion device **3*a*1 further includes a shift member 23 and a shift actuator 24*a*1. The shift member 23 is connected to the shift mechanism 13. The shift member 23 operates the shift mechanism 13**.

Specifically, the shift member 23 is connected to the clutch 21. The shift member 23 is driven by a shift actuator **24*a*1. Thus, the clutch 21** moves to each of the forward position, the reverse position, and the neutral position.

The shift actuator **24*a*1 is connected to the shift member 23. The shift actuator 24*a*1 drives the shift member 23. The shift actuator 24*a*1 is, for example, an electric motor. The shift actuator 24*a*1 switches the clutch 21 between the forward position, the reverse position, and the neutral position by driving the shift member 23**.

The bracket 16 attaches the left propulsion device **3*a*1 to the ship 1. The left propulsion device 3*a*1 is detachably fixed to the stern of the ship 1 via the bracket 16. The bracket 16 includes a steering shaft 25. The left propulsion device 3*a*1 is supported by the bracket 16 so as to rotate around a steering shaft 25**.

Figure 3:
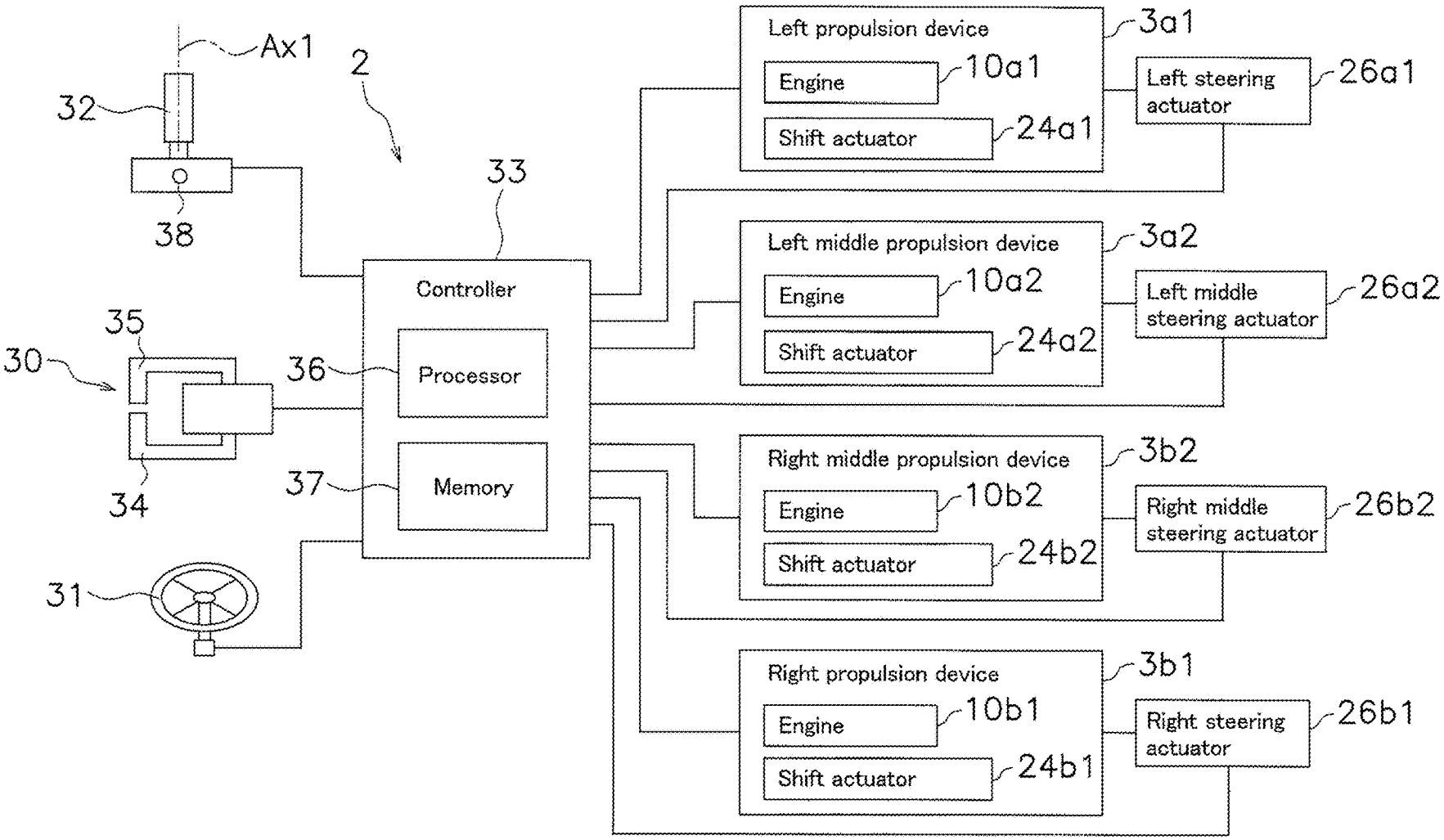
FIG. 3 is a schematic diagram showing a ship maneuvering system according to a preferred embodiment of the present invention.

FIG. 3 is a schematic diagram showing the configuration of the ship maneuvering system 2. The ship maneuvering system 2 includes a left propulsion device **3*a*1, a left middle propulsion device 3*a*2, a right propulsion device 3*b*1, and a right middle propulsion device 3*b*2. Each of the left middle propulsion device 3*a*2, the right propulsion device 3*b*1, and the right middle propulsion device 3*b*2 has the same configuration (the configuration in FIG. 2) as the left propulsion device 3*a*1**, as described above.

As shown in FIG. 3, each of the left propulsion device **3*a*1, the left middle propulsion device 3*a*2, the right propulsion device 3*b*1, and the right middle propulsion device 3*b*2 includes engines 10*a*1, 10*a*2, 10*b*1, 10*b*2 and shift actuators 24*a*1, 24*a*2, 24*b*1, 24*b*2**.

The ship maneuvering system 2 includes a plurality of steering actuators **26*a*1, 26*a*2, 26*b*1, 26*b*2. The plurality of steering actuators 26*a*1, 26*a*2, 26*b*1, 26*b*2 are respectively connected to the left propulsion device 3*a*1, the left middle propulsion device 3*a*2, the right propulsion device 3*b*1, and the right middle propulsion device 3*b*2**.

Each of the steering actuators **26*a*1, 26*a*2, 26*b*1, 26*b*2 rotates each of the propulsion devices 3*a*1, 3*a*2, 3*b*1, 3*b*2 around the steering shaft 25**.

Each of the steering actuators **26*a*1, 26*a*2, 26*b*1, 26*b*2 changes the steering angles of each of the propulsion devices 3*a*1, 3*a*2, 3*b*1, 3*b*2**.

Each of the steering actuators **26*a*1, 26*a*2, 26*b*1, 26*b*2 includes, for example, a hydraulic cylinder. Each of the steering actuators 26*a*1, 26*a*2, 26*b*1, 26*b*2** may include an electric cylinder or an electric motor.

The ship maneuvering system 2 further includes a remote control device 30, a steering device 31, a joystick 32 (an example of an operator), and a controller 33.

The remote control device 30 includes a first operator 34 and a second operator 35. The first operator 34 is operated by a user to control the left propulsion device **3*a*1 and the left middle propulsion device 3*a*2. The first operator 34 is, for example, a lever. The first operator 34 is operable between a forward position, a reverse position, and a neutral position. The remote control device 30 transmits a signal indicating an operation of the first operator 34 to the controller 33**.

The second operator 35 is operated by a user to control the right propulsion device **3*b*1 and the right middle propulsion device 3*b*2. The second operator 35 has the same configuration as the first operator 34. The remote control device 30 transmits a signal indicating an operation of the second operator 35 to the controller 33**.

The steering device 31 is, for example, a steering wheel. The steering device 31 is operated by a user to control the steering angles of the propulsion devices **3*a*1, 3*a*2, 3*b*1, 3*b*2. The steering device 31 is operable to a left turning position, a right turning position, and a neutral position. The steering device 31 transmits a signal indicating the position of the steering device 31 to the controller 33**.

The joystick 32 is tiltable. The joystick 32 is able to be operated in the front, rear, left, right, and oblique directions therebetween. The joystick 32 is operable 360 degrees in all directions around the rotation axis Ax1 of the joystick 32. The joystick 32 is able to be twisted around the rotation axis Ax1.

The joystick 32 transmits a signal indicating the tilt direction and the tilt amount of the joystick 32 to the controller 33. The signal indicating the tilt direction and the tilt amount of the joystick 32 corresponds to an "operation signal to rotate the ship". The joystick 32 transmits a signal indicating the twist direction and the twist amount of the joystick 32 to the controller 33.

The joystick 32 transmits a signal indicating the position of the joystick 32 to the controller 33. The position of the joystick 32 is defined by data indicating the tilt direction and the tilt amount of the joystick 32. Further, the position of the joystick 32 is defined by data indicating the twist direction and the twist amount of the joystick 32.

The controller 33 includes a processor 36 and a memory (an example of a recorder). The memory 37 includes a volatile memory such as a RAM. The memory 37 includes a nonvolatile memory such as a ROM. The controller 33 may include an auxiliary storage device such as a hard disk and/or an SSD. Further, an external storage device (not illustrated) such as a hard disk and/or an SSD (not illustrated) may be connected to the controller 33.

The processor 36 is, for example, a CPU (Central Processing Unit), and executes processes to control the propulsion devices **3*a*1, 3*a*2, 3*b*1, 3*b*2 and the steering actuators 26*a*1, 26*a*2, 26*b*1, 26*b*2** according to a program.

The memory 37 stores programs and data to control the propulsion devices **3*a*1, 3*a*2, 3*b*1, 3*b*2 and the steering actuators 26*a*1, 26*a*2, 26*b*1, 26*b*2**.

The memory 37 stores first table data (an example of information data) indicating a relationship between the operation amount of the joystick 32 and the backward thrust of each of the propulsion devices 3*a*1, 3*a*2, 3*b*1, 3*b*2. The memory 37 stores second table data indicating the relationship between the amount of twist of the joystick 32 and the rotation speed of each of the engines 10*a*1, 10*a*2, 10*b*1, 10*b*2.

Further, the memory 37 stores a predetermined threshold. For example, the predetermined threshold is set to a real number multiple of a minimum backward thrust of each of the propulsion devices 3*a*1, 3*a*2, 3*b*1, 3*b*2. The predetermined threshold is able to be set and changed arbitrarily. In the present preferred embodiment, for example, the predetermined threshold is set to 2.1 times the minimum backward thrust. The minimum backward thrust and the magnification are stored in the memory 37. The minimum backward thrust of each of the propulsion device 3*a*1, 3*a*2, 3*b*1, 3*b*2 is smaller than the minimum forward thrust of each of the propulsion device 3*a*1, 3*a*2, 3*b*1, 3*b*2.

The controller 33 controls the propulsion devices 3*a*1, 3*a*2, 3*b*1, 3*b*2 and the steering actuators 26*a*1, 26*a*2, 26*b*1, 26*b*2 based on signals from the steering device 31, the remote control device 30, and the joystick 32.

Specifically, the controller 33 controls the direction and magnitude of the thrust of each of the left propulsion device 3*a*1 and the left middle propulsion device 3*a*2 according to the position of the first operator 34.

The controller 33 controls the shift actuators 24*a*1, 24*a*2 according to the position of the first operator 34. Thus, the clutch 21 of the shift mechanism 13 is switched between the forward position, the reverse position, and the neutral position. As a result, the thrust of each of the left propulsion device 3*a*1 and the left middle propulsion device 3*a*2 is switched among forward, rear, and neutral.

The controller 33 controls the magnitude of the thrust of each of the left propulsion device 3*a*1 and the left middle propulsion device 3*a*2 according to the position of the first operator 34. For example, the controller 33 controls the magnitude of the thrust of each of the left propulsion device 3*a*1 and the left middle propulsion device 3*a*2 by controlling a throttle opening of the engines 10*a*1, 10*a*2.

The controller 33 controls the direction and magnitude of the thrust of each of the right propulsion device 3*b*1 and the right middle propulsion device 3*b*2 according to the position of the second operator 35.

The controller 33 controls the shift actuators 24*b*1, 24*b*2 according to the position of the second operator 35. Thus, the thrust of each of the right propulsion device 3*b*1 and the right middle propulsion device 3*b*2 is switched among forward, rear, and neutral as well as the left propulsion device 3*a*1 and the left middle propulsion device 3*a*2.

The controller 33 controls the magnitude of the thrust of each of the right propulsion device 3*b*1 and the right middle propulsion device 3*b*2 according to the position of the second operator 35. For example, the controller 33 controls the magnitude of the thrust of each of the right propulsion device 3*b* and the right middle propulsion device 3*b*2 by controlling the throttle opening of the engines 10*b*1, 10*b*2.

The controller 33 controls the steering actuators 26*a*1, 26*a*2, 26*b*1, 26*b*2 according to the position of the steering device 31. Thus, the steering angles of the propulsion devices 3*a*1, 3*a*2, 3*b*1, 3*b*2 are controlled.

The controller 33 controls the propulsion devices 3*a*1, 3*a*2, 3*b*1, 3*b*2 and the steering actuators 26*a*1, 26*a*2, 26*b*1, 26*b*2 according to the position of the joystick 32.

For example, the controller 33 controls the thrust and the steering angle of each of the propulsion devices 3*a*1, 3*a*2, 3*b*1, and 3*b*2 such that the ship 1 performs a translation motion in a direction corresponding to the tilt direction of the joystick 32.

Specifically, when the tilt direction of the joystick 32 is a front-back direction, the controller 33 controls the propulsion devices 3*a*1, 3*a*2, 3*b*1, 3*b*2 and the steering actuators 26*a*, 26*b* in the front-back movement mode.

Figure 4B:
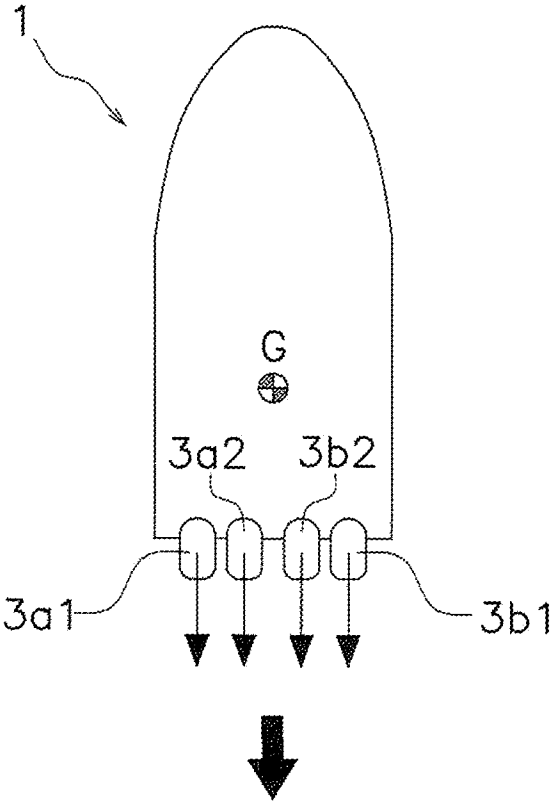
FIG. 4B is a diagram showing backward thrust in a backward movement mode.
Figure 4A:
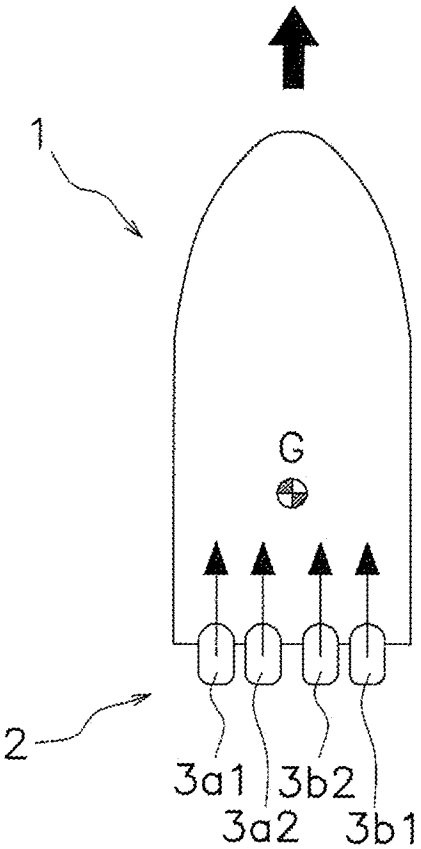
FIG. 4A is a diagram showing forward thrust in a forward movement mode.

FIGS. 4A and 4B are diagrams showing thrusts in the forward and backward movement mode. When the tilt direction of the joystick 32 is forward, the controller 33 sets the propulsion devices 3*a*1, 3*a*2, 3*b*1, 3*b*2 such that the propulsion devices 3*a*1, 3*a*2, 3*b*1, 3*b*2 are parallel to each other in the front-rear direction.

The controller 33 sets the propulsion devices 3*a*1, 3*a*2, 3*b*1, 3*b*2 to forward, and sets the thrusts of the propulsion devices 3*a*1, 3*a*2, 3*b*1, 3*b*2 to the same magnitude. Thus, the ship 1 moves forward (see FIG. 4A). When the tilt direction of the joystick 32 is backward, the controller 33 controls the propulsion devices 3*a*1, 3*a*2, 3*b*1, 3*b*2 in the opposite direction to the above (see FIG. 4B).

Further, the controller 33 controls the thrust and the steering angle of each of the propulsion devices 3*a*1, 3*a*2, 3*b*1, 3*b*2 such that the ship 1 pivotally turns or turns on the turning circle in a direction corresponding to the tilt direction of the joystick 32.

Specifically, when the joystick 32 is twisted, the controller 33 controls the propulsion devices 3*a*1, 3*a*2, 3*b*1, 3*b*2 in the pivot turning mode. In the pivot turning mode, the controller 33 controls the thrust and the steering angle of each of the propulsion devices 3*a*1, 3*a*2, 3*b*1, 3*b*2 such that the ship 1 pivotally turns in a direction corresponding to the twisting direction of the joystick 32.

FIGS. 5A to 6B are diagrams showing the thrust in the turning mode. When the joystick 32 is twisted, the controller 33 sets the steering angle of each of the plurality of propulsion devices 3*a*1, 3*a*2, 3*b*1, 3*b*2 such that the propulsion devices 3*a*1, 3*a*2, 3*b*1, 3*b*2 are parallel to each other in the front-rear direction.

Figure 5B:
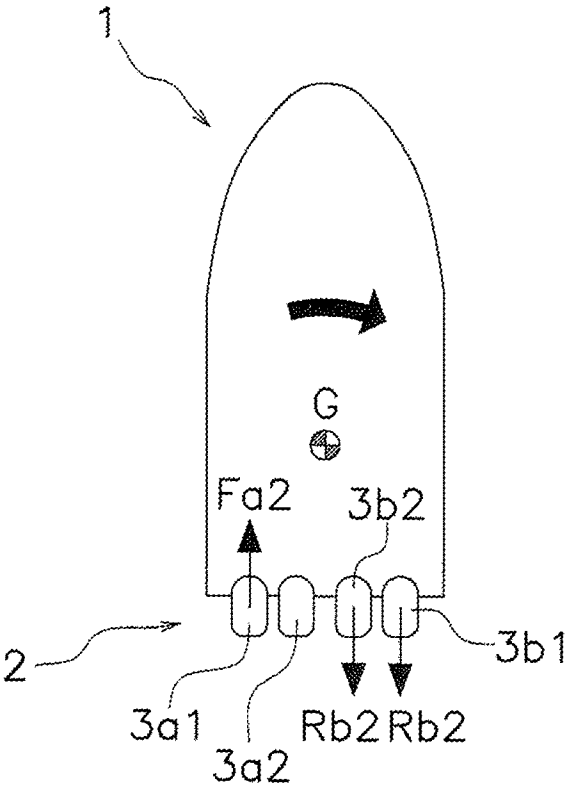
FIG. 5B is a diagram showing thrusts when pivotally turning the ship clockwise in the pivot turning mode (high output state).
Figure 5A:
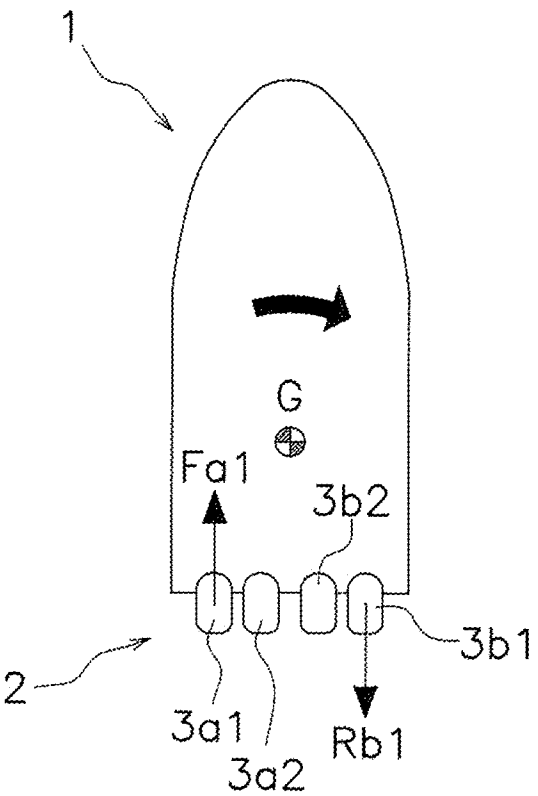
FIG. 5A is a diagram showing thrusts when pivotally turning the ship clockwise in a pivot turning mode (low output state).

For example, when the twisting direction of the joystick 32 is clockwise, as shown in FIGS. 5A and 5B, the ship 1 pivotally turns clockwise. In this case, in the low output state illustrated in FIG. 5A, the controller 33 sets the left and right propulsion devices 3*a*1, 3*b*1 such that the left propulsion device 3*a*1 generates the first forward thrust Fa1 and the right propulsion device 3*b*1 generates the first backward thrust Rb1.

On the other hand, in the high output state illustrated in FIG. 5B, the controller 33 sets the left and right propulsion devices 3*a*1, 3*b*1 such that the left propulsion device 3*a*1 generates the second forward thrust Fa2 and the right propulsion device 3*b*1 and the right middle propulsion device 3*b*2 generate the second backward thrust Rb2.

Figure 6B:
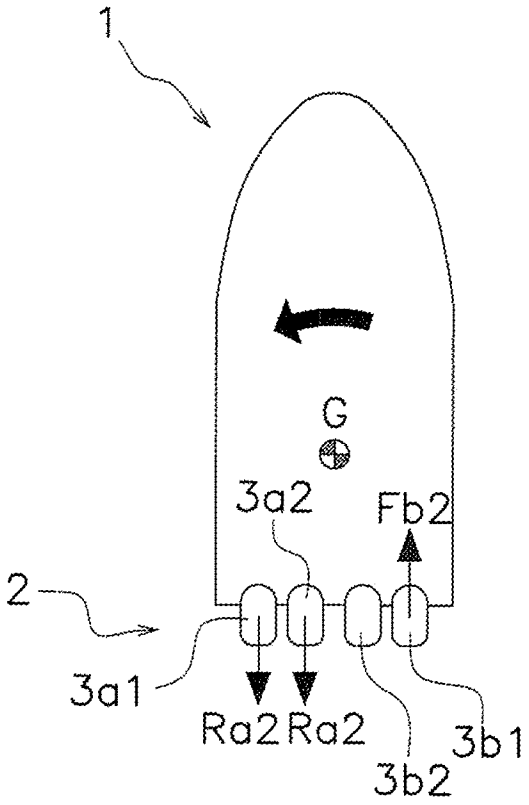
FIG. 6B is a diagram showing thrusts when pivotally turning the ship counterclockwise in the pivot turning mode (high output state).
Figure 6A:
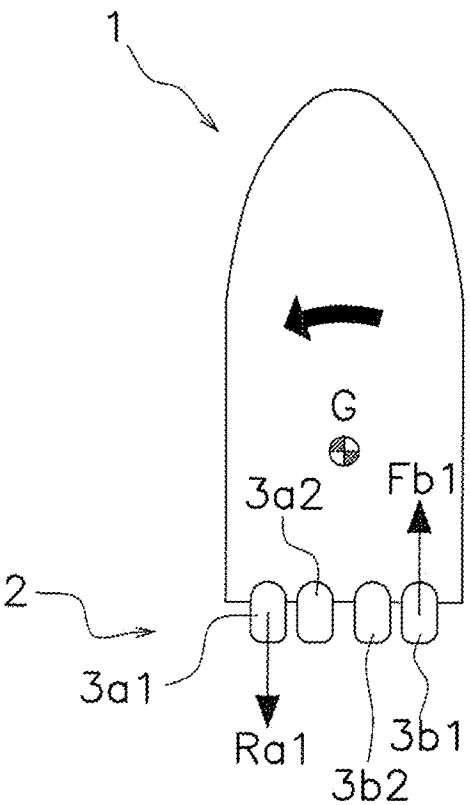
FIG. 6A is a diagram showing thrusts when pivotally turning the ship counterclockwise in the pivot turning mode (low output state).

For example, when the twisting direction of the joystick 32 is counterclockwise, as shown in FIGS. 6A and 6B, the ship 1 pivotally turns counterclockwise. In this case, in the low output state illustrated in FIG. 6A, the controller 33 sets the left and right propulsion devices 3*a*1, 3*b*1 such that the left propulsion device 3*a*1 generates the first backward thrust Ra1 and the right propulsion device 3*b*1 generates the first front thrust Fb1.

On the other hand, in the high output state illustrated in FIG. 6B, the controller 33 sets the left and right propulsion devices 3*a*1, 3*b*1 such that the left propulsion device 3*a*1 and the left middle propulsion device 3*a*2 generate the second backward thrust Ra2 and the right propulsion device 3*b*1 generates the second forward thrust Fb2.

The controller 33 changes the thrust of each of the propulsion device 3*a*1, 3*a*2, 3*b*1, 3*b*2 according to the twist amount of the joystick 32. For example, the controller 33 controls each of the propulsion devices 3*a*1, 3*a*2, 3*b*1, 3*b*2 such that the greater the twist amount of the joystick 32 is, the greater the thrust of each of the propulsion devices 3*a*1, 3*a*2, 3*b*1, 3*b*2 is. Thus, the output of the ship 1 is switched from the low output state illustrated in FIGS. 5A and 6A to the high output state illustrated in FIGS. 5B and 6B.

The controller 33 switches the output of the ship 1 from the low output state to the high output state based on the first backward thrust Rb1 of the right propulsion device 3*b*1 or the first backward thrust Ra1 of the left propulsion device 3*a*1 in the low output state. Switching between the low output state and the high output state will be described below.

Figure 7:
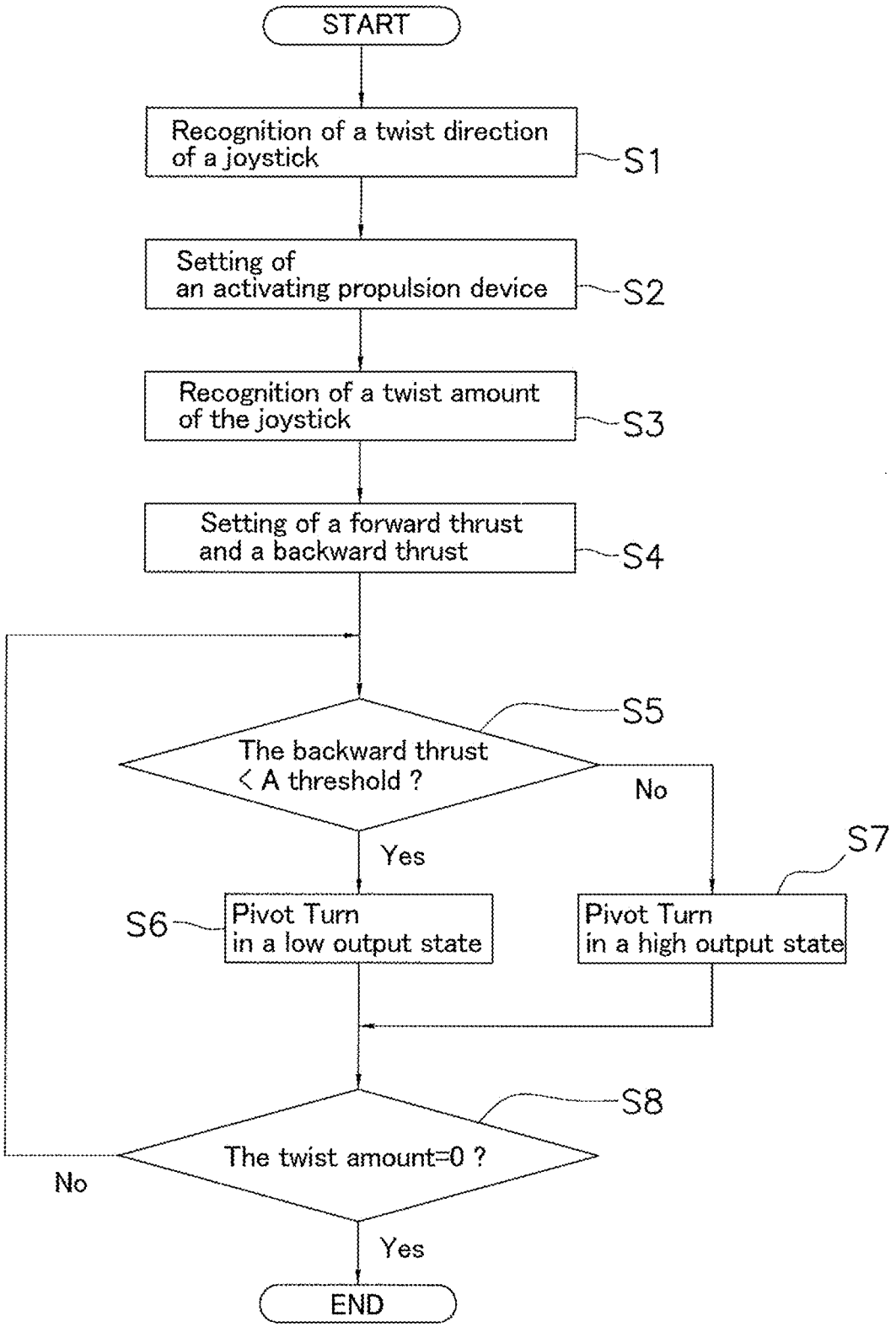
FIG. 7 is a flowchart showing processes performed by the ship maneuvering system in the pivot turning mode.

FIG. 7 is a flowchart showing a process executed by the controller 33 when the ship 1 pivotally turns. In other words, the flowchart of FIG. 7 shows the process in the pivot turning mode.

When the controller 33 acquires the signal corresponding to the twisting operation of the joystick 32, the controller 33 starts the pivotal turning control of the ship 1.

First, the controller 33 recognizes the twist direction of the joystick 32 (S1). When the twisting direction of the joystick 32 is clockwise, the controller 33 starts control of the plurality of propulsion devices 3*a*1, 3*a*2, 3*b*1, 3*b*2 such that the ship 1 pivotally turns clockwise.

On the other hand, when the twist direction of the joystick 32 is counterclockwise, the controller 33 starts control of the plurality of propulsion devices 3*a*1, 3*a*2, 3*b*1, 3*b*2 such that the ship 1 turns counterclockwise.

In the following description, as shown in FIGS. 5A and 5B, the process executed by the ship maneuvering system 2 will be described using an example in which the ship 1 pivotally turns by twisting the joystick 32 clockwise for ease of explanation.

As described above, when the controller 33 recognizes the twisting direction of the joystick 32, the controller 33 controls the propulsion device that generates the first forward thrust Fa1 and the propulsion device that generates the first backward thrust Rb1 (S2).

For example, the controller 33 generates the first forward thrust Fa1 for the left propulsion device 3*a*1 (an example of a first propulsion device) (see FIG. 5A). The controller 33 instructs a starting command to rotate the engine 10*a*1 of the left propulsion device 3*a*1 such that the left propulsion device 3*a*1 generates the first forward thrust Fa1.

Further, the controller 33 generates the first backward thrust Rb1 for the right propulsion device 3*b*1 (an example of the second propulsion device) (see FIG. 7A). For example, the controller 33 instructs a starting command to rotate the engine 10*b*1 of the right propulsion device 3*b*1 such that the right propulsion device 3*b*1 generates the first backward thrust Rb1.

The controller 33 sets the rotation speeds of the engines 10*a*1, 10*b*1 of the left propulsion device 3*a*1 and the right propulsion device 3*b*1 such that the first forward thrust Fa1 and the first backward thrust Rb1 are equal. Thus, the pivotal turning direction of the ship 1 is set, and the ship 1 starts the pivotal turning operation in a low output state.

Next, the controller 33 recognizes the twist amount of the joystick 32 (S3). The controller 33 sets the first forward thrust Fa1 and the first backward thrust Rb1 according to the twist amount of the joystick 32 (S4).

For example, as described above, the second table data indicates the relationship between the twist amount of the joystick 32 and the rotation speed of each of the engines 10*a*1, 10*a*2, 10*b*1, and 10*b*2. The controller 33 changes the rotation speed of each of the engines 10*a*1, 10*a*2, 10*b*1, 10*b*2 based on the second table data.

Specifically, when the twist amount of the joystick 32 increases, the controller 33 increases the rotation speeds of the engines 10*a*1, 10*b*1 of the left propulsion device 3*a*1 and the right propulsion device 3*b*1 based on the second table data. Thus, the first forward thrust Fa1 and the first backward thrust Rb1 increase.

On the other hand, when the twist amount of the joystick 32 decreases, the controller 33 reduces the rotation speeds of the engines 10*a*1, 10*b*1 of the left propulsion device 3*a*1 and the right propulsion device 3*b*1 based on the second table data. Thus, the first forward thrust Fa1 and the first backward thrust Rb1 decrease.

The controller 33 changes the rotation speeds of the engines 10*a*1, 10*b*1 of the left propulsion device 3*a*1 and the right propulsion device 3*b*1 such that the first forward thrust Fa1 and the first backward thrust Rb1 are equal.

When the rotation speed of the engine 10*a*1 of the left propulsion device 3*a*1 is the same as the rotation speed of the engine 10*b*1 of the right propulsion device 3*b*1, the first backward thrust Rb1 acting on the ship 1 is smaller than the first forward thrust Fa1 acting on the ship 1.

Therefore, the controller 33 controls the left propulsion device 3*a*1 and the right propulsion device 3*b*1 such that the rotation speed of the engine 10*b*1 of the right propulsion device 3*b*1 for the backward thrust is greater than the rotation speed of the engine 10*a*1 of the left propulsion device 3*a*1 for the forward thrust in order to equalize the first forward thrust Fa1 and the first backward thrust Rb1 at each time in the time series.

Subsequently, the controller 33 determines whether or not the current backward thrust RF of the right propulsion device 3*b*1 is less than the predetermined threshold (S5). The predetermined threshold is set to twice the minimum backward thrust as described above.

Specifically, the controller 33 recognizes the current backward thrust RF of the right propulsion device 3*b*1 based on the twist amount of the joystick 32. For example, as described above, the first table data indicates the relationship between the operation amount of the joystick 32 and the backward thrust RF of each propulsion device 3*a*1, 3*a*2, 3*b*1, 3*b*2. The controller 33 recognizes the backward thrust RF of the right propulsion device 3*b*1 corresponding to the twist amount of the joystick 32 based on the first table data. The controller 33 determines whether or not the backward thrust RF of the right propulsion device 3*b*1 is less than the predetermined threshold.

When the backward thrust RF of the right propulsion device 3*b*1 is less than the predetermined threshold (Yes in S5), the controller 33 generates the above-described first forward thrust Fa1 for the left propulsion device 3*a*1. In this case, the controller 33 generates the above-described first backward thrust Rb1 for the right propulsion device 3*b*1. In this state, the ship 1 pivotally turns around in the low output state (S6).

On the other hand, when the backward thrust RF of the right propulsion device 3*b*1 is equal to or greater than the predetermined threshold (No in S5), the controller 33 generates the second forward thrust Fa2 for the left propulsion device 3*a*1. In this case, the controller 33 generates the second backward thrust Rb2 with each of the right propulsion device 3*b*1 and the right middle propulsion device 3*b*2.

Thus, the ship 1 starts the pivotal turning operation in the high output state (S7). When the ship 1 performs the pivotal turning operation in the high output state, the second backward thrust Rb2 of each of the right propulsion device 3*b*1 and the right middle propulsion device 3*b*2 is equal.

When the ship 1 pivotally turns in the high output state, the controller 33 controls the rotation speed of each of the left propulsion device 3*a*1, the right propulsion device 3*b*1, and the right middle propulsion device 3*b*2 based on the second table data, as well as the case when the ship 1 pivotally turns in the low output state.

The controller 33 constantly monitors the backward thrust RF of the right propulsion device 3*b*1. The controller 33 changes the number of the propulsion devices 3*b*1, 3*b*2 based on the backward thrust RF of the right propulsion device 3*b*1. At the time when the number of the propulsion devices 3*b*1, 3*b*2 is changed, the second backward thrust Rb2 of each of the right propulsion device 3*b*1 and the right middle propulsion device 3*b*2 is smaller than the first backward thrust Rb1 of the right propulsion device 3*b*1. In other words, the rotation speed of each of the engines 10*b*1, 10*b*2 in the high output state is smaller than the rotation speed of the engine 10*b*1 in the low output state.

Subsequently, the controller 33 determines whether or not the twisting operation of the joystick 32 has been released (S8). For example, the state in which the twist operation of the joystick 32 is released is a state in which the twist amount of the joystick 32 is zero. In this case, the controller 33 determines whether the twist amount of the joystick 32 has returned to zero.

When the twisting operation of the joystick 32 is released (Yes in S8), the controller 33 ends the pivotal turning control of the ship 1. On the other hand, when the twisting operation of the joystick 32 is continued (No in S8), the controller 33 continues to monitor the first backward thrust Rb1 (S5). As shown in FIGS. 6A and 6B, the ship 1 pivotally turns counterclockwise by turning the joystick 32 counterclockwise. In this case, the propulsion device for the forward thrust is the right propulsion device 3*b*1, and the propulsion device for the backward thrust is the left propulsion device 3*a*1 and the left middle propulsion device 3*a*2. The controller 33 executes the above-described process on these propulsion devices 3*b*1, 3*a*1, and 3*a*2.

In the ship maneuvering system 2 described above, the controller 33 controls the left propulsion device 3*a*1 and the right propulsion device 3*b*1 such that the rotation speed of the engine 10*b*1 of the right propulsion device 3*b*1 for the backward thrust is larger than the rotation speed of the engine 10*a*1 of the left propulsion device 3*a*1 for the forward thrust in order to equalize the first forward thrust Fa1 and the first backward thrust Rb1 at each time in the time series.

In this state, when the pivotal turning state of the ship 1 is switched from the low output state to the high output state based on the first forward thrust Fa1 (Fb1) as in the prior art, the number of propulsion devices for the backward thrust increases in the state in which the rotation speed of the engine 10*b*1 (10*a*1) of the right propulsion device 3*b*1 (3*a*1) for the backward thrust is large. In this case, since the rotational speed of the right propulsion devices 3*b*1 (3*a*1) for the backward thrust is large, the rotational speed of each of the propulsion devices for the backward thrust is greatly reduced when the number of propulsion devices for the backward thrust is increased. For this reason, there is a possibility that shock and noise accompanying the change of the rotation speed of each of the propulsion devices occur on the ship 1.

On the other hand, in the ship maneuvering system 2, the minimum backward thrust of the first backward thrust Rb1 (Ra1) is smaller than the minimum front thrust of the first front thrust Fa1 (Fb1). Also, the pivotal turning state of the ship 1 is switched from the low output state to the high output state based on the minimum backward thrust (the predetermined threshold) of the first backward thrust Rb1 (Ra1). Thus, in the ship maneuvering system 2, the number of propulsion devices is changed in a low rotation speed region as compared with the prior art. For this reason, in the ship maneuvering system 2, the shock and the noise caused by change of the rotation speed of each of propulsion devices is suitably reduced as compared with the prior art.

Figure 8B:
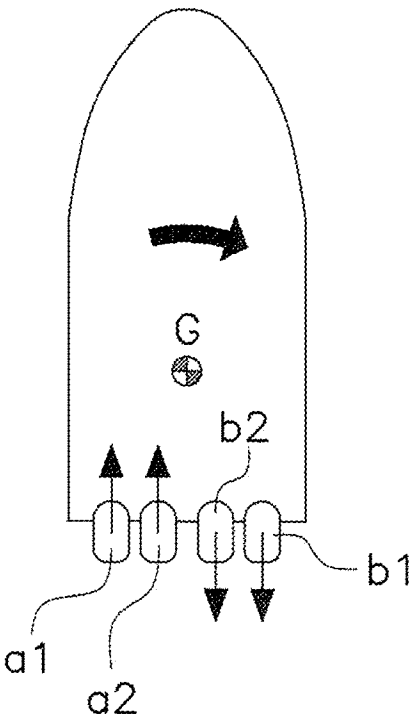
FIG. 8B PRIOR ART
FIG. 8B is a diagram explaining the conventional technique.
Figure 8A:
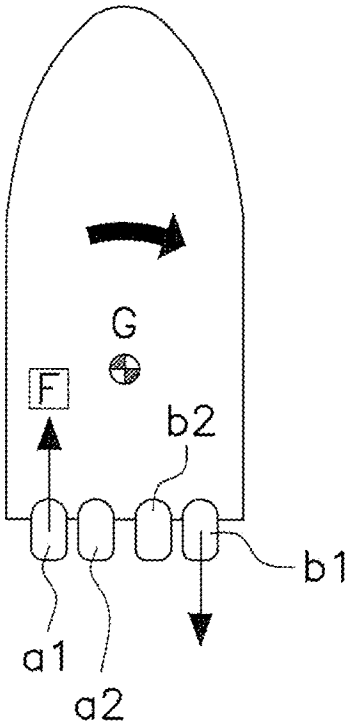
FIG. 8A PRIOR ART
FIG. 8A is a diagram explaining a conventional technique.

Further, in the prior art, as shown in FIGS. 8A and 8B, the number of both the propulsion devices a1, a2 that generate the forward thrust and the propulsion devices b1, b2 that generate backward thrust changes. On the other hand, in the ship maneuvering system 2, the number of propulsion devices 3*b*1, 3*b*2 (3*a*1, 3*a*1) that generate the backward thrust changes. The number of propulsion devices 3*a*1 (3*b*1) that generate the forward thrust does not change. Thus, in the ship maneuvering system 2, since the number of switched propulsion devices is reduced as compared with the prior art, the shock and the noise is reduced appropriately when the number of propulsion devices changes.

In the above-described preferred embodiments, the process executed by the ship maneuvering system 2 has been described using the example in which the ship 1 pivotally turns, but the ship maneuvering system 2 is also applicable when the ship 1 turns on the turning circle.

In the above-described preferred embodiments, an example in which the ship 1 includes four propulsion devices 3*a*1, 3*a*2, 3*b*1, 3*b*2 has been described. The ship 1 can have four or more propulsion devices.

In the above-described preferred embodiments, an example in which the process of the ship maneuvering system 2 is executed by operating the joystick 32 has been described. The remote control device 30 (the first operator 34 and the second operator 35) can alternatively be used. For example, the ship maneuvering system 2 can be executed by operating the first operator 34 in the front or rear direction and the second operator 35 in a reverse direction (the rear or front direction).

According to preferred embodiments of the present invention, it is possible to reduce shock and noise when the number of propulsion devices changes.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A ship maneuvering system comprising:

a plurality of first propulsion devices;

a plurality of second propulsion devices;

an operator to output an operation signal to rotate the ship; and a controller configured or programmed to:

generate a first forward thrust with the plurality of first propulsion devices and generate a first backward thrust with the plurality of second propulsion devices with a same number of propulsion devices as the plurality of first propulsion devices when the backward thrust is less than a predetermined threshold; and to generate a second forward thrust larger than the first forward thrust with the plurality of first propulsion devices and generate a second backward thrust with each of the plurality of second propulsion devices greater than the number of the plurality of first propulsion devices when the backward thrust is greater than or equal to the predetermined threshold; wherein the predetermined threshold is set to a real number multiple of a minimum thrust of the backward thrust.

2. The ship maneuvering system according to claim 1, wherein the controller is configured or programmed to generate the first forward thrust or the second forward thrust with at least one of the plurality of first propulsion devices.

3. The ship maneuvering system according to claim 1, wherein the controller is configured or programmed to control each of the plurality of second propulsion devices such that the second backward thrust of each of the plurality of second propulsion devices is equal when the backward thrust is equal to or greater than the predetermined threshold.

4. The ship maneuvering system according to claim 1, wherein the controller includes a recorder to record the predetermined threshold and information data indicating a relationship between an operation amount of the operator and the backward thrust.

5. The ship maneuvering system according to claim 1, wherein the operator includes a joystick.

6. A ship maneuvering method executed by a controller to maneuver a ship including a plurality of first propulsion devices and a plurality of second propulsion devices, the method comprising:

acquiring an operation signal to rotate the ship;

generating a forward thrust with the plurality of first propulsion devices and generating a backward thrust with the plurality of second propulsion devices based on the operation signal;

generating a first forward thrust with the plurality of first propulsion device and generating a first backward thrust with the plurality of second propulsion devices with a same number of propulsion devices as the plurality of first propulsion devices when the backward thrust is less than a predetermined threshold;

generating a second forward thrust larger than the first forward thrust with the plurality of first propulsion devices and generating a second backward thrust with each of the plurality of second propulsion devices greater than a number of the plurality of first propulsion devices when the backward thrust is greater than or equal to the predetermined threshold; wherein the predetermined threshold is set to a real number multiple of a minimum thrust of the backward thrust.

7. The ship maneuvering method according to claim 6, further comprising:

generating the first forward thrust or the second forward thrust with at least one of the plurality of first propulsion devices.

8. The ship maneuvering method according to claim 6, further comprising:

controlling each of the plurality of second propulsion devices such that the second backward thrust of each of the plurality of second propulsion devices is equal when the backward thrust is equal to or greater than the predetermined threshold.

9. The ship maneuvering method according to claim 6, further comprising:

acquiring the predetermined threshold and information data indicating a relationship between an operation amount of the operator and the backward thrust.

10. The ship maneuvering method according to claim 6, wherein the operator includes a joystick.

* * * * *